US007137483B2

(12) United States Patent
Kato et al.

(10) Patent No.: US 7,137,483 B2
(45) Date of Patent: Nov. 21, 2006

(54) ROPE AND ELEVATOR USING THE SAME

(75) Inventors: Kensuke Kato, Tsuchiura (JP); Takashi Teramoto, Tsuchiura (JP); Hiromi Inaba, Hitachi (JP); Hiroshi Nagase, Hitachinaka (JP); Ichiro Nakamura, Hitachinaka (JP); Yuuji Yoshitomi, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 580 days.

(21) Appl. No.: 10/110,961

(22) PCT Filed: Jan. 22, 2001

(86) PCT No.: PCT/JP01/00387

§ 371 (c)(1),
(2), (4) Date: Apr. 18, 2002

(87) PCT Pub. No.: WO01/68973

PCT Pub. Date: Sep. 20, 2001

(65) Prior Publication Data

US 2003/0089551 A1 May 15, 2003

(30) Foreign Application Priority Data

Mar. 15, 2000 (JP) ..... 2000-077776

(51) Int. Cl.
*B66B 11/04* (2006.01)

(52) U.S. Cl. ..... 187/251; 187/266; 187/411; 187/414; 57/231; 57/232

(58) Field of Classification Search ..... 187/254, 187/411, 264; 57/218, 217
See application file for complete search history.

(56) References Cited

U.S. PATENT DOCUMENTS 3,346,074 A * 10/1967 Borden et al. ..... 187/375
3,395,530 A * 8/1968 Campbell ..... 57/230
3,824,777 A 7/1974 Riggs
3,874,158 A 4/1975 Chiappetta et al.

(Continued)

FOREIGN PATENT DOCUMENTS

JP U-61-165978 7/1986

(Continued)

OTHER PUBLICATIONS

Communication from the EPO with observations by a third party, dated Feb. 4, 2004, for No. EP 01 90 1497.

*Primary Examiner*—Kathy Matecki
*Assistant Examiner*—Stefan Kruer
(74) *Attorney, Agent, or Firm*—Antonelli, Terry, Stout and Kraus, LLP.

(57) ABSTRACT

An elevator in which the sheave diameter is reduced and the attendant lowering of the rope life and strength is suppressed to secure safety and reliability. To this end, a rope is used in which a plurality of element wires constituting the wire rope are each covered with resin material and the whole wire rope is covered with resin material, thereby reducing the wear due to slippage between the element wires and the wear due to contact with the sheave, which wear occurs when the rope is entrained around the sheave. When the elevator sheave diameter is reduced, a worried lowering of the rope life can be suppressed or the rope life can be improved. Thus, it is possible to achieve reduction of size and weight of equipment including motors and hoists, installation space saving for elevators, improved safety and reliability of the system by virtue of the increased rope life.

10 Claims, 17 Drawing Sheets

U.S. PATENT DOCUMENTS 4,120,145 A 10/1978 Chiappetta et al.
4,123,894 A * 11/1978 Hughes et al. ..... 57/220
4,197,695 A * 4/1980 Hughes et al. ..... 57/217
4,344,278 A 8/1982 Jamison et al.
4,509,319 A * 4/1985 Yoshida et al. ..... 57/218
4,606,183 A 8/1986 Riggs
4,807,723 A * 2/1989 Salmon et al. ..... 187/266
5,461,850 A * 10/1995 Bruyneel et al. ..... 57/218
5,651,245 A * 7/1997 Damien ..... 57/218

FOREIGN PATENT DOCUMENTS

| | | |
|---|---|---|
| JP | A-7-267534 | 10/1995 |
| JP | A-8-261972 | 10/1996 |
| JP | A-9-21084 | 1/1997 |
| JP | A-11-293574 | 10/1999 |
| WO | WO 98/16681 | 4/1998 |
| WO | WO 99/43885 | 9/1999 |

* cited by examiner

ROPE AND ELEVATOR USING THE SAME

TECHNICAL FIELD

The present invention relates to a rope type elevator, and in particular, to an elevator using a wire rope that comprises wires coated with resin material and an outer periphery of which is coated with resin material.

BACKGROUND ART

A rope type elevator includes a driving apparatus comprising a motor, a speed reducer, a sheave and a deflector wheel, and has a mechanism of subjecting a load of a cage to one end of a main rope (hereinafter referred to as a "rope") wound around the sheave and a load of a counterweight to the other end of the rope to move up and down the cage and the counterweight by means of friction between the rope and the sheave.

The rope is generally formed by twisting together strands which are formed by twisting together steel wires. This steel rope satisfies a friction characteristic, an abrasion-resistance characteristic, a fatigue-resistance characteristic and the like required to drive the elevator and is high reliability.

However, since the rope is a consumable article, there is life. The life factors of the rope are classified into four categories, that is, fatigue resulting from bending and extending of the rope effected when the rope passes around the sheave, abrasion resulting from mutual movement of the wires, abrasion of wires present in the outermost layer of the rope due to their contact with wall surfaces of groove in the sheave, and corrosion caused by contact of the rope with air. Thus, for the purpose of reducing influence due to repeated bending of the rope effected when the rope passes around the sheave, a ratio D/d of a diameter D of the sheave to a diameter d of the rope has been set at 40 or more.

On the other hand, the diameter D of the sheave directly relates to a driving torque of the motor required to move go and down the cage. To reduce the size and weight of an elevator system including a motor, the diameter of the sheave must be reduced.

Further, the steel rope is wound around the sheave made of cast iron and is frictionally driven. Therefore, vibration and noise occur due to metal contact when the rope is caught in the sheave, thereby affecting comfortableness.

As means for solving these problems, in JP-A-7-267534 specification described is a method of reducing the sheave diameter as well as vibration and noise by using a rope which is formed by twisting together synthetic fibers such as aramid fibers that are more flexible than steel wires and coating with a resin such as urethane.

Further, in order to determine the life of a synthetic fiber rope coated with a resin, in JP-A-8-261972 specification described is a method of embedding a conductive carbon fiber, which is weaker than a synthetic fiber, in a synthetic fiber rope coated with a resin and checking by the voltage whether or not the conductive carbon fiber is broken to determine the life of the rope.

On the other hand, the higher the contact pressure with the sheave becomes, the shorter the life of the rope becomes. That is, the contact pressure (Prope) of the rope is proportional to tension F of the rope and is inversely proportional to the diameter D of the sheave. Thus, if the sheave diameter is reduced, the pressure increases (Prope nearly equals to F/(D/d)).

As means for solving this, in PCT WO 99/43,885 specification described is a method of using a flat-belt, which is formed by arranging in a line a plurality of strands formed by twisting together steel wires or synthetic fibers such as aramid fibers to coat these strands with a resin, to reduce pressure associated with contact with the sheave to extend the life of the resin coated on a surface of the flat-belt.

To reduce diameter of sheave of mechanical systems using a rope, including a rope type elevator, to reduce the size of an electric motor or hoist driving the sheave and to reduce a setting area of the mechanical system, it is necessary to suppress decreases in the life and strength of the rope associated with decrease in bending radius of the rope.

It is an object of the present invention to provide a safe and reliable rope by suppressing decreases in the life and strength of the rope if the bending radius of the rope is reduced.

It is another object of the present invention to provide a safe and reliable elevator by suppressing decreases in the life and strength of a rope if the sheave diameter is reduced.

DISCLOSURE OF THE INVENTION

To attain the above-described objects, a rope according to the present invention is structured by twisting together a plurality of wires coated with a resin material to form strands, twisting a plurality of the strands to form a wire rope, and coating an outer periphery of the wire rope with a resin material.

Furthermore, the present invention provides an elevator in which a cage and a counterweight is connected together by a plurality of ropes and the ropes are wound around sheave driven by a motor and are frictionally driven, wherein, a plurality of steel wires coated with a resin are twisted together to form strands, a plurality of strands are twisted together to form one rope, an outer periphery of the entire wire rope is coated with resin material, and the wire rope is generally a circle in a cross section perpendicular to an axial direction of the rope.

BEST MODE FOR CARRYING OUT THE INVENTION

The present invention will be described with reference to the drawings.

A wire rope as a load supporting member is formed by twisting steel wires together to form strands and further twisting the strands together. The rope has been used as a running rope in a wide range of mechanical systems including an elevator by being wound around or caught in a sheave because of its flexibility. The rope, made of steel, is a consumable part, so that extension of its life contributes to improvement of reliability and safety. As described above, to reduce possible fatigue and abrasion due to repeated bending of the rope upon passing around the sheave, the repeated bending being one of the factors affecting the life of the steel rope, the ratio (D/d) of the sheave diameter D to the rope diameter d is set at a certain value or more (for elevators, this value is set at 40 or more) according to the mechanical system.

Figure 1:
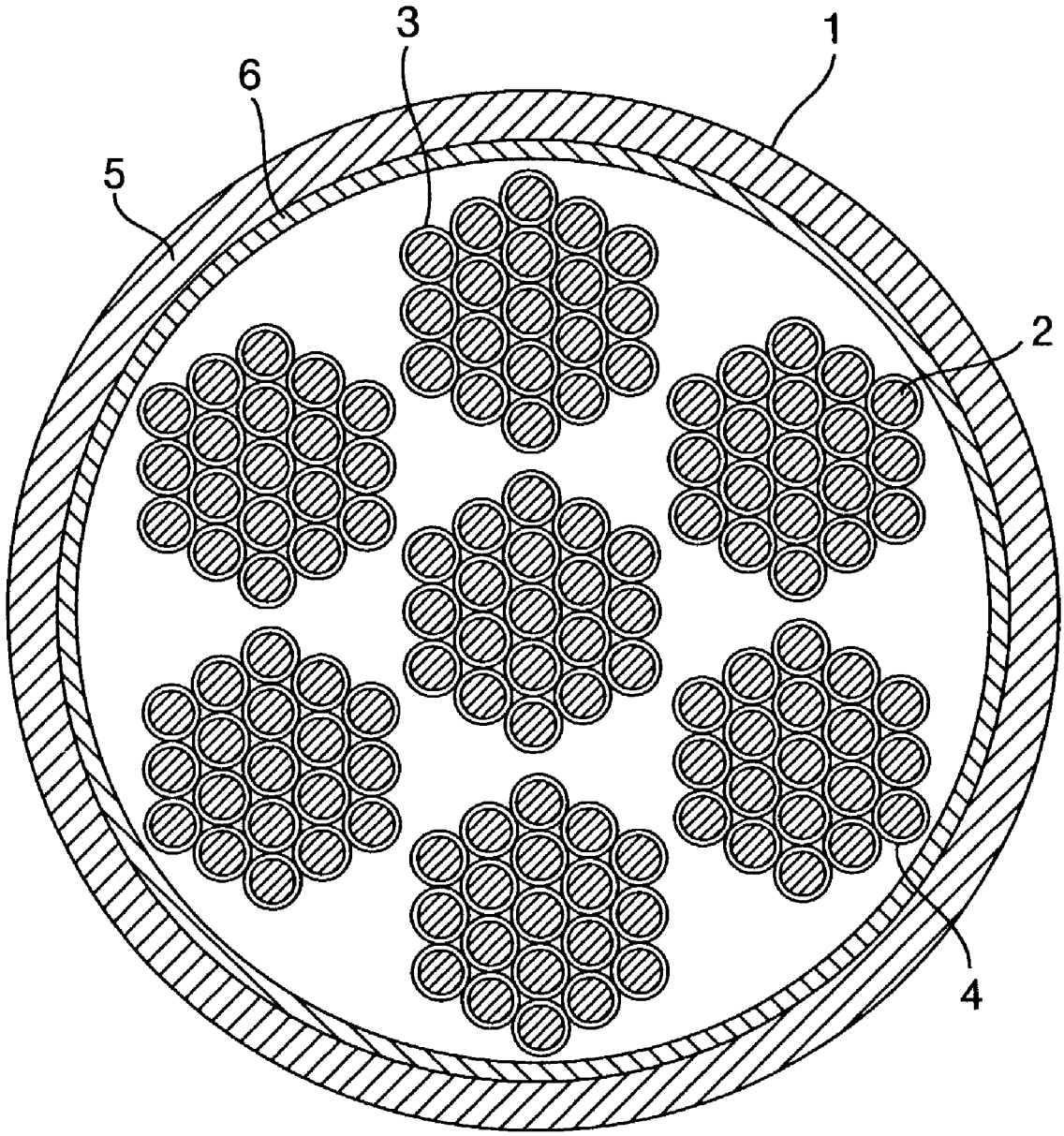
FIG. 1 is a schematic sectional view of a first embodiment of a rope of the present invention.

Reduction of the sheave diameter contributes to reduce the size, space, and cost of the mechanical system. To minimize the adverse effects of the four factors concerning the life of the rope as described above, the rope of the present invention is constructed as shown in the following embodiments:

Referring to FIG. 1, a wire rope 1 which is a load supporting member is structured by twisting steel wires 2 together to form strands 3 and further twisting the strands 3 together. Each wire 2 is covered with a wire coating 4, the whole of the rope 1 is coated with an intermediate coating material 6, and its outermost layer is covered with a rope coating 5.

In case of reduction of the sheave diameter or in case of an elevator, in order to set the ratio D/d of the sheave diameter D to the rope diameter d at less than 40 which is a conventional value, among the life factors described in the prior art discussion, the fatigue characteristic of the rope 1 must be improved which results from bending thereof upon passing around the sheave. Thus, bending stress acting on the wires 2 constituting the rope 1 was focused on, and a shape of the wire required upon reduction of the sheave diameter was examined. When the rope as a running rope is wound around the sheave, bending stress $\sigma b$ acts on the wires 2. Here, the maximum bending stress ($\sigma b\max$) occurs in an outermost layer of each wire 2 in a cross section, and the value of the stress is proportional to distance from a center of the wire 2. That is, the value is proportional to the diameter $\delta$ of the wire 2. When the modulus of longitudinal elasticity of the wire 2 is represented as E, the maximum bending stress $\delta b\max$ is expressed by the following equation:

$$\sigma b\max = E\delta/D$$

Further, stress amplitude $\sigma a$ repeatedly acting on the outermost layer of the wire 2 is expressed by the following equation:

$$\sigma a = E\delta/2D$$

Figure 2:
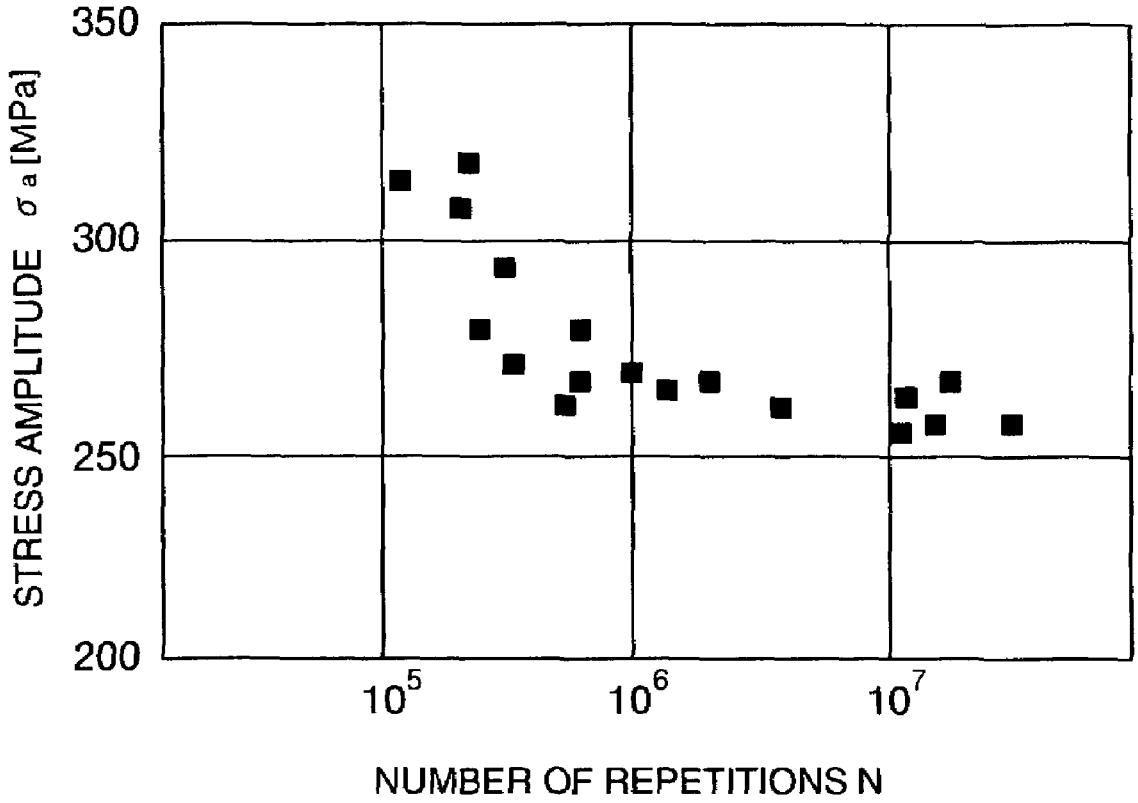
FIG. 2 is a chart showing results of fatigue tests on wires of the rope shown in FIG. 1.

On the basis of these equations, possible stress occurring in the wire 2 can be reduced by reducing the diameter $\delta$ of the wire 2. Conventional elevators use a sheave of which diameter is 500 mm and wire rope of which diameter of the wires is 0.8 mm. Thus, as an example, steel wires containing 0.7% carbon and having a diameter of 0.3 mm were used to conduct fatigue tests by partially pulsating tension and a fatigue limit $\sigma a1$ was determined. Average stress at that time was 500 MPa. The results thereof are shown in FIG. 2. With this, it was clearly found that the fatigue limit $\sigma a1$ is about 260 MPa of the stress amplitude $\sigma a$.

Accordingly, if a wire rope is formed using the wires described above on which the fatigue tests were conducted and the diameter of the sheave of the elevator is reduced, the following equation must be satisfied in order to set the ratio D/d of the sheave diameter D to the rope diameter d at 40 or less.

$$E\delta/2D < 260(MPa)$$

For example, in an elevator system using the conventional steel wires, a sheave diameter D is 500 mm and a rope diameter d is 12 mm, and the wires constituting the rope 1 have a diameter of 0.8 mm. The ratio D/d of the sheave diameter D to the rope diameter d is 41.7. In contrast, with the wire rope of the present embodiment, if the sheave diameter D is reduced to 200 mm, the rope diameter d is set at 12 mm, and the wires constituting the rope 1 have a diameter $\delta$ of about 0.50 mm, then the value D/d becomes 16.7 mm. In addition, if the sheave diameter D is reduced to 100 mm, the rope diameter d is set to 12 mm, and the wires constituting the rope 1 have a diameter $\delta$ of about 0.25 mm, the value D/d becomes 8.3 mm.

From the view point of fatigue, the bending stress $\sigma b$ occurring in the wire 2 can be reduced by reducing the diameter $\delta$ of the wire 2 as described above. On the other hand, to reduce the diameter of the wire 2 affects the life of the rope if the abrasion by mutual movement of the wires 2, which is a life factor concerning the rope, is taken into consideration. The mutual movement of the wires 2, that is, slippage distance increases as the rope diameter d increases. To reduce the distance of the mutual movement, it is desirable that the rope diameter d is small. However, reduction of the rope diameter d also reduces the breaking strength of the rope 1, so that the breaking strength of the wires 2 must be increased. Therefore, the wires 2 constituting the rope 1 may have a breaking strength of 1,770 MPa or more.

Further, in the present embodiment, the surface of each wire 2 is covered with the wire coating 4 in order to reduce abrasion caused by the mutual movement of the wires 2. The wire coating 4 is composed of a resin such as polyethylene, polyamide, ethylene tetrafluoride, polyurethane, epoxy, or vinyl chloride. The wire coating 4 has a smaller modulus of elasticity in comparison with steel, so that when the wires 2 come into contact with each other, a sufficient contact area is obtained to allow the wires to slide under a low surface pressure. As a result, the wires 2 are prevented from coming into local concentrated contact with each other, thereby reducing their abrasion.

The wire coating 4, intended to reduce the abrasion of the wires 2, is formed of material undergoing lower plastic flow pressure than steel, that is, soft coating material. Frictional force associated with mutual contact slippage of the wires 2 is generally represented by the product Aw·s of the contact area Aw and the shearing strength s of the material. In this case, the contact area Aw substantially equals (vertical load)/(plastic flow pressure of the material), so that steel, which is a base material, has a small contact area. Accordingly, shearing associated with the mutual slippage of the wires 2 is received by the wire coating 4, which is formed of soft coating material with a low shearing strength, and the vertical load is supported by the steel wires 2, which is the base material, so that low friction is obtained. Also in case that solid lubricant such as molybdenum sulfide or graphite is used to the soft coating material forming the wire coating 4, the same effect is provided.

In case of reducing the diameter δ of the wires 2 and the sheave diameter D, abrasion caused by contact between the outermost wires of the rope 1 and the sheave groove must be considered in addition to the abrasion resulting from the mutual slippage of the wires 2. Therefore, in the present embodiment, to reduce the abrasion between the wires 2 and the sheave groove, the surface of the outermost layer of the rope 1 is covered with the rope coating 5 as shown in FIG. 1. For the material for the rope coating 5, one of the above-described coating materials for the wires 2 may be used. In general, abrasion has a close relationship with a ratio of the contact surface pressure to the yield pressure of the material, so that by reducing this ratio, it is possible to reduce an amount of the abrasion. That is, as described above, reduction of contact surface pressure is effective in reducing the amount of the abrasion. In comparison with the case in which the wires 2 directly come into contact with the sheave groove, the case in which the entire rope 1 is covered with the coating in a closed state and comes into contact with the sheave groove can increase the radius of curvature at contact points to enlarge the contact area, that is, reduce the contact surface pressure. Further, other than the radius of curvature at the contact points, it is possible to increase the contact area and to reduce the contact pressure by lowering the modulus of elasticity of the material.

The intermediate coating material 6 is arranged between the wires 2 and the rope coating 5 applied to the outermost layer and reduces abrasion of the rope coating 5 from the inside. Further, the rope coating 5 also has a function of shielding the entire rope 1 from the ambient air, thereby improving the corrosion resistance of the rope 1. Therefore, the rope 1 ensures stable reliability and life even in mechanical systems installed outdoors. Further, it is desirable that the rope coating material is inflammable. Furthermore, the rope coating 5 can be arbitrarily colored, and therefore, it is possible to make the mechanical systems installed outdoors or indoors have wide possibility in design thereof.

Since the rope 1 of the invention is constructed as described above, the steel wires 2 do not directly contact with each other or with the sheave groove. Thus, in the strand 3 formed by twisting a plurality of the wires 2 together, the wires arranged in the outermost layer need not be provided with an abrasion resistance characteristic. It is desirable that the rope 1 according to the present invention is formed of Wallington type strands 3 of which wires 2 have a substantially equal diameter δ.

When reducing the diameter D of the sheave in order to facilitate the reduction of the size and weight of the mechanical system, a method of twisting the rope 1 also affects the flexibility of the rope in addition to the reduction of the bending stress due to small sizing of the diameter of the wires, the wire coating 4 on the wires 2 for reducing abrasion associated with the reduced diameter of the wires and the rope coating 5 on the entire rope 1. In general, the method of twisting the rope 1 used in the mechanical system includes Lang's lay that the wires 2 and the strands 3 are twisted in the same direction and ordinary lay that the wires 2 and the strands 3 are twisted in opposite directions.

In a Lang's lay rope, an angle that the wires 2 form with respect to a central axis of the rope 1 is larger in comparison with that in an ordinary lay rope. Therefore, the flexibility of the whole of the Lang's lay rope with respect to bending is high. Thus, in a case that the rope 1 of the present embodiment is utilized in the reduction of the diameter of the sheave, for example, in an elevator, the rope 1 formed using the Lang's lay is used when the rope is used in a condition that the ratio D/d of the sheave diameter D to the rope diameter d is lower than 40. Further, in a Lang's lay rope, wires appearing on the surface of the rope are longer and the surface is smoother in comparison with the ordinary lay rope, so that the Lang's lay rope undergoes few local contact and a low contact surface pressure. Thus, when the rope 1 is caught in the sheave, a compressive stress acting upon the rope coating is lower in comparison with the ordinary lay rope. The contact pressure between the rope 1 and the sheave increases as the sheave diameter decreases. Taking the fatigue and life of the rope coating 5 into consideration, in a case that the rope 1 of the present embodiment is utilized in the reduction of the diameter of the sheave, for example, in an elevator, the rope 1 formed using the Lang's lay is used when the rope is used in a condition that the ratio D/d of the sheave diameter D to the rope diameter d is lower than 40.

On the other hand, with the ordinary lay rope, when tension acts on the rope, resistance against rotations in an untwisting direction increases. Thus, if the rope 1 of the present embodiment is applied to a mechanical system that gives top priority to suppression of rotation of the rope 1, the rope 1 formed using the ordinary lay is used.

Degradation and life of the rope 1 as a load supporting member may occur due to breakage of the wires 2 constituting the rope 1. Determination of degradation of the rope 1, the outermost layer of which is covered with the rope coating 5, is carried out by detecting breakage of the wires 2 constituting the load supporting member by means of a magnetic flaw detecting such as magnetic leakage flux testing.

Figure 3:
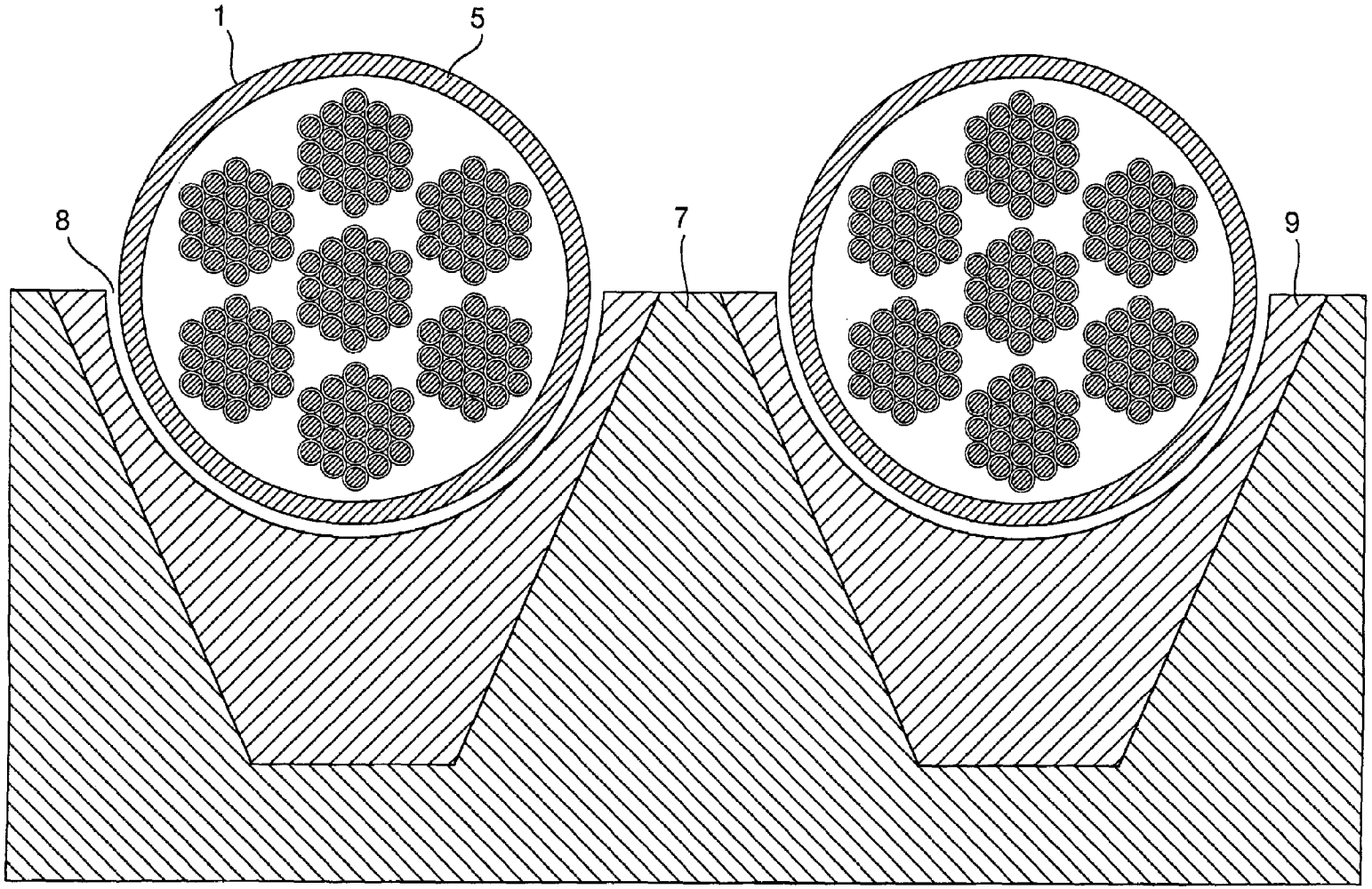
FIG. 3 is a schematic view showing that the rope in FIG. 1 is being caught in a sheave groove.

FIG. 3 is a schematic sectional view showing that the rope 1 of the present invention is being caught in a sheave 7. In the case of an elevator, the rope 1 is caught in a sheave groove 8, and an electric motor (not shown) is used to rotate the sheave 7 so that the rope 1 is driven by frictional force generated between the rope 1 and the sheave groove 8. The sheave groove 8 is formed in a lining 9 fitted in the sheave 7 and the lining 9 is detachably mounted on the sheave 7. Considering frictional force generated between the lining 9 and the rope coating 5 and possible abrasion, the lining 9 is structured by a resin such as polyurethane, polyamide, or polyethylene. By using these resin materials, contact with the rope coating material 5, which is similar to these resin materials, becomes elastic or viscoelastic resin friction and sufficient frictional force for an elevator can be obtained. Instead of the lining 9, also in coating of resin material, appropriate frictional force and abrasion resistance can be obtained.

Figure 4:
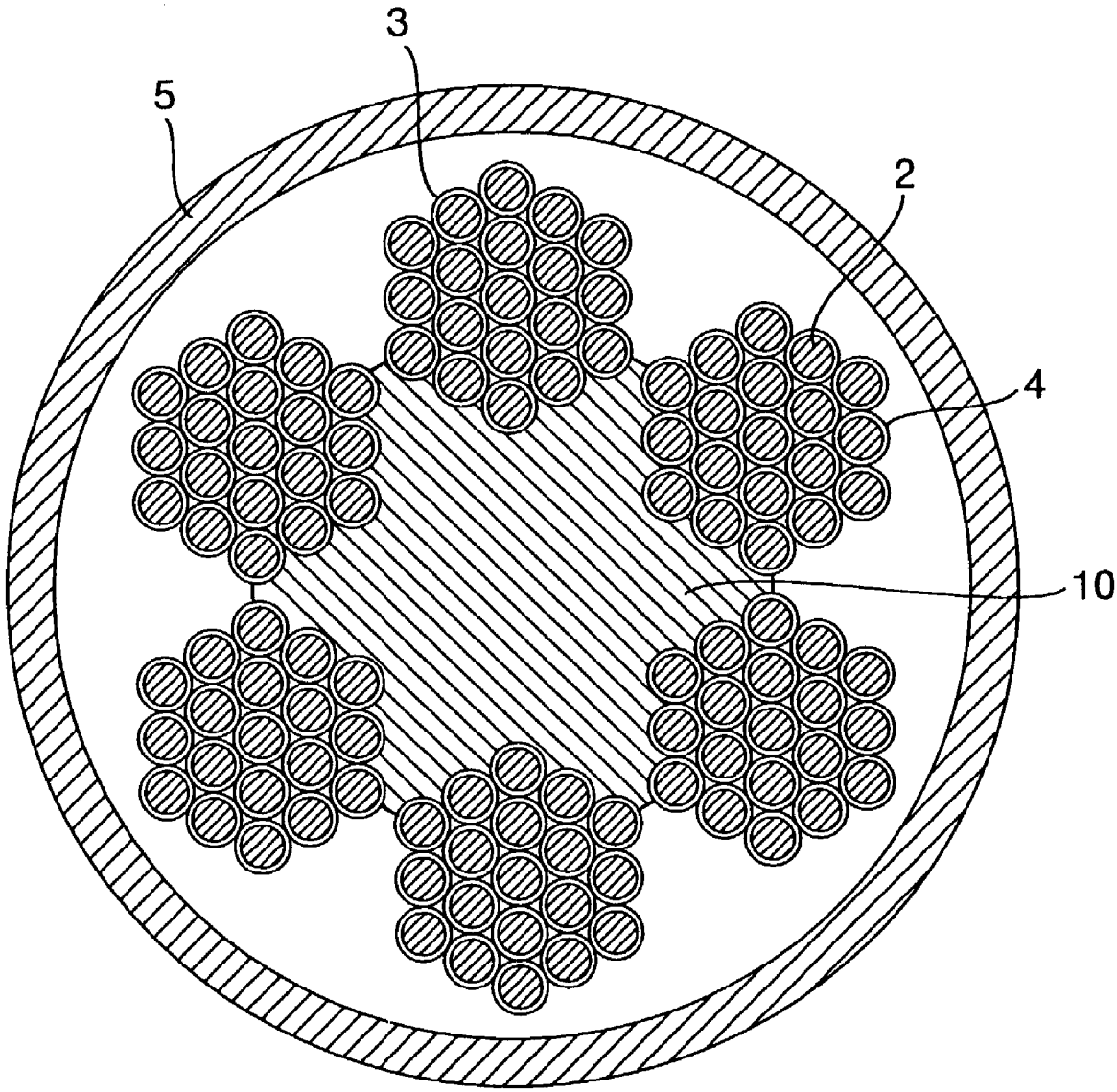
FIG. 4 is a schematic sectional view of a second embodiment of the rope of the present invention.

FIG. 4 is a schematic sectional view of a second embodiment of the rope of the present invention. This embodiment differs from the first embodiment in that a fiber core 10 is arranged in the center of the rope 1. This fiber core 10 is formed of natural fibers such as cannabis or synthetic fibers such as polypropylene, polyester, polyamide, polyethylene, aramid, or PBO. With the present configuration, it is possible to reduce the abrasion of the wires 2 or wire coating 4 caused by the mutual slippage of the strands 3 when the rope is subjected to tension or wound around the sheave 7 and thus bent. Further, by forming the fiber core 10 using strong synthetic fibers, the breaking strength of the rope 1 is increased. In this case, the twisting of the fiber core is set so that an elongation of the strands 3 formed of the steel wires 2 matches that of the fiber core so as to appropriately distribute loads to both strands 3 and the fiber core. The rope core material may be resin material such as polyurethane, polyamide, or polyethylene.

Figure 5:
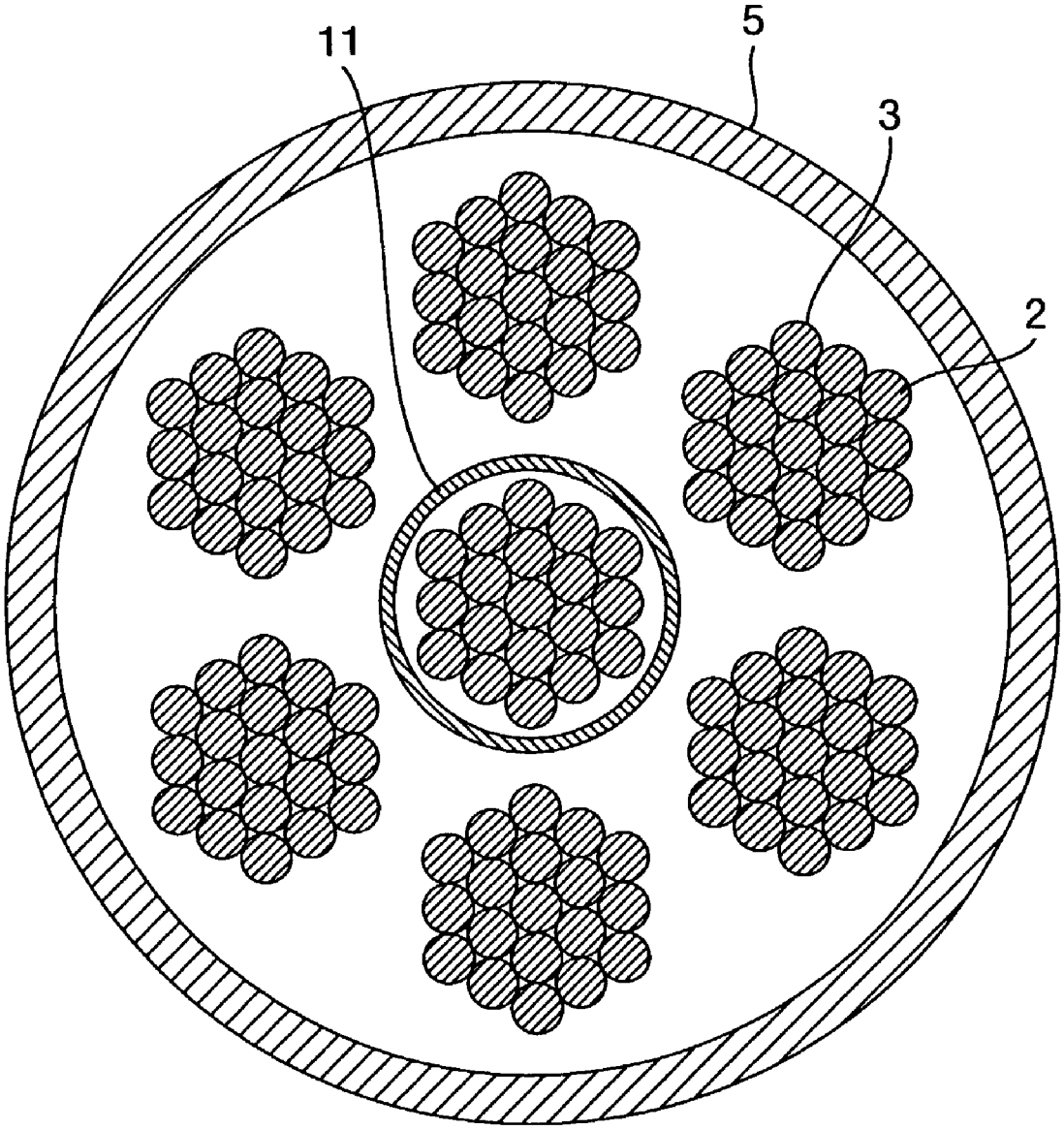
FIG. 5 is a schematic sectional view of a third embodiment of the rope of the present invention.

FIG. 5 is a schematic sectional view of a third embodiment of the rope of the present invention. This embodiment differs from the first embodiment in that the strand 3 arranged in the center of the rope is covered with a strand coating 11. The strand coating 11 is formed of resin material such as polyurethane, polyamide, or polyethylene. This reduces the abrasion of the wires 2 or the wire coating 4 caused by the mutual slippage of the strands 3 as in the above embodiments. All the strands 3 may be strand-coated.

Figure 6:
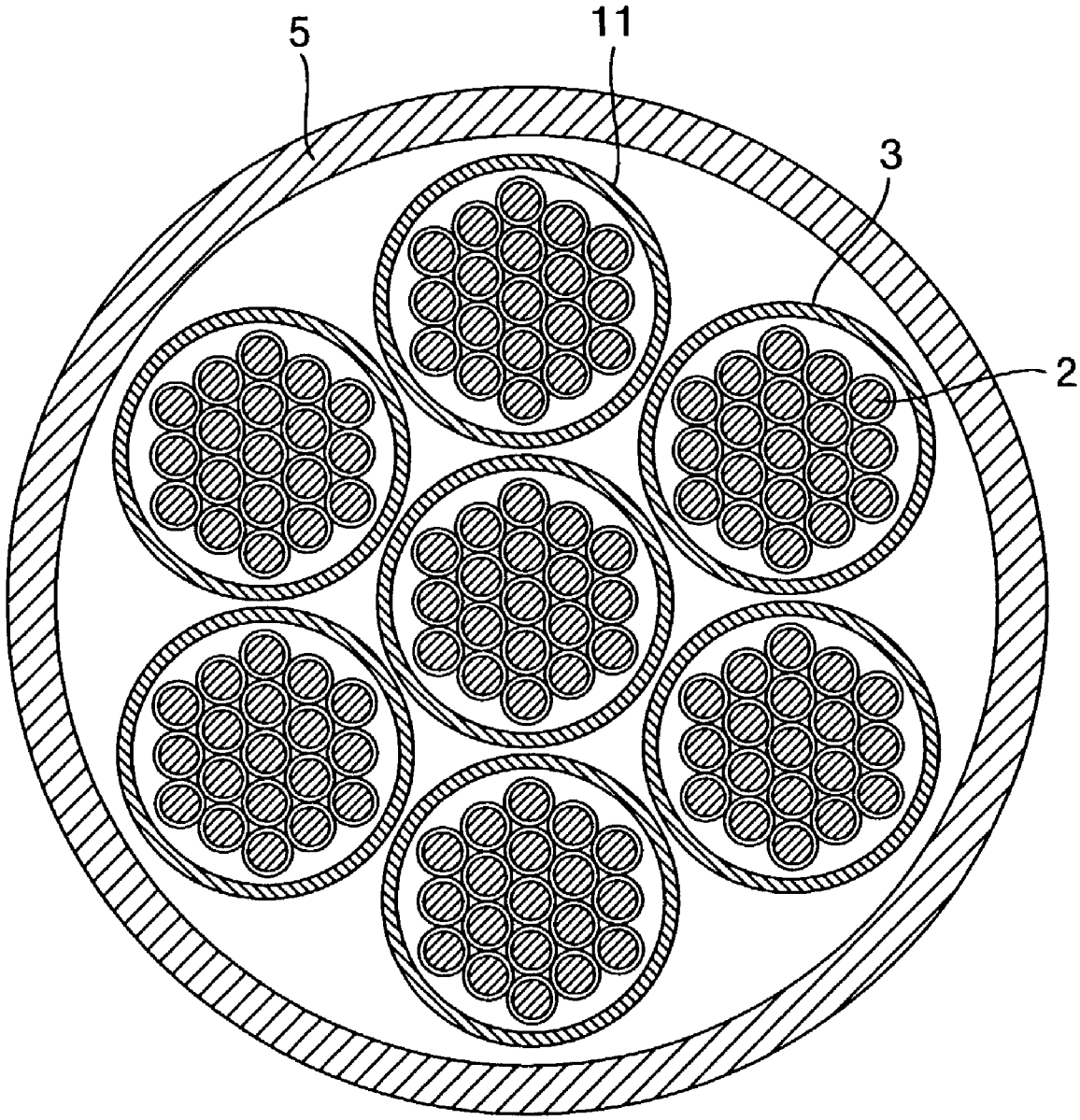
FIG. 6 is a schematic sectional view of a fourth embodiment of the rope of the present invention.

FIG. 6 is a schematic sectional view of a fourth embodiment of the rope of the present invention. This embodiment differs from the first embodiment in that all the strands 3 are covered with the strand coating 11. This more effectively reduces the abrasion of the wires 2 or the wire coating 4 caused by the mutual slippage of the strands 3, than the above-described embodiments.

Figure 7:
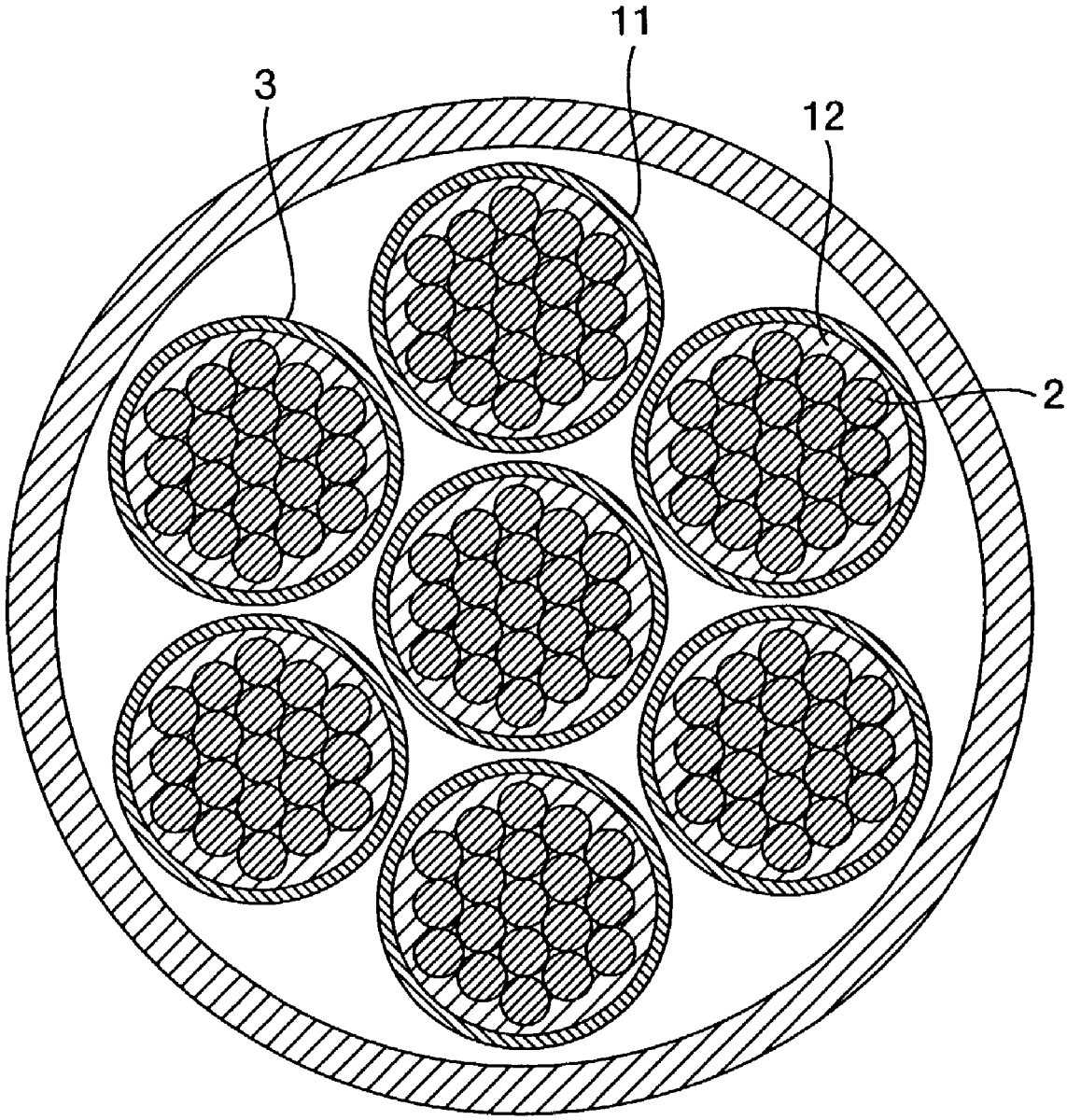
FIG. 7 is a schematic sectional view of a fifth embodiment of the rope of the present invention.

FIG. 7 is a schematic sectional view of a fifth embodiment of the rope of the present invention. This embodiment differs from a sixth embodiment in that the wires are not coated but each strand 3 is covered with the strand coating 11 and filled with a lubricant 12. The lubricant 12 is solid lubricant such as molybdenum sulfide or graphite, or grease. With this construction, even if the rope 1 is bent, the lubricant 12 serves to reduce the abrasion caused by the mutual slippage of the wires 2. In this connection, by coating each wire 2 and further sealing the lubricant into each strand, the life of the rope can be further extended than the sixth embodiment. In the above-described embodiments, the life of the rope can be extended by filling each strand with the same material as the above coating material, as filler.

Figure 8:
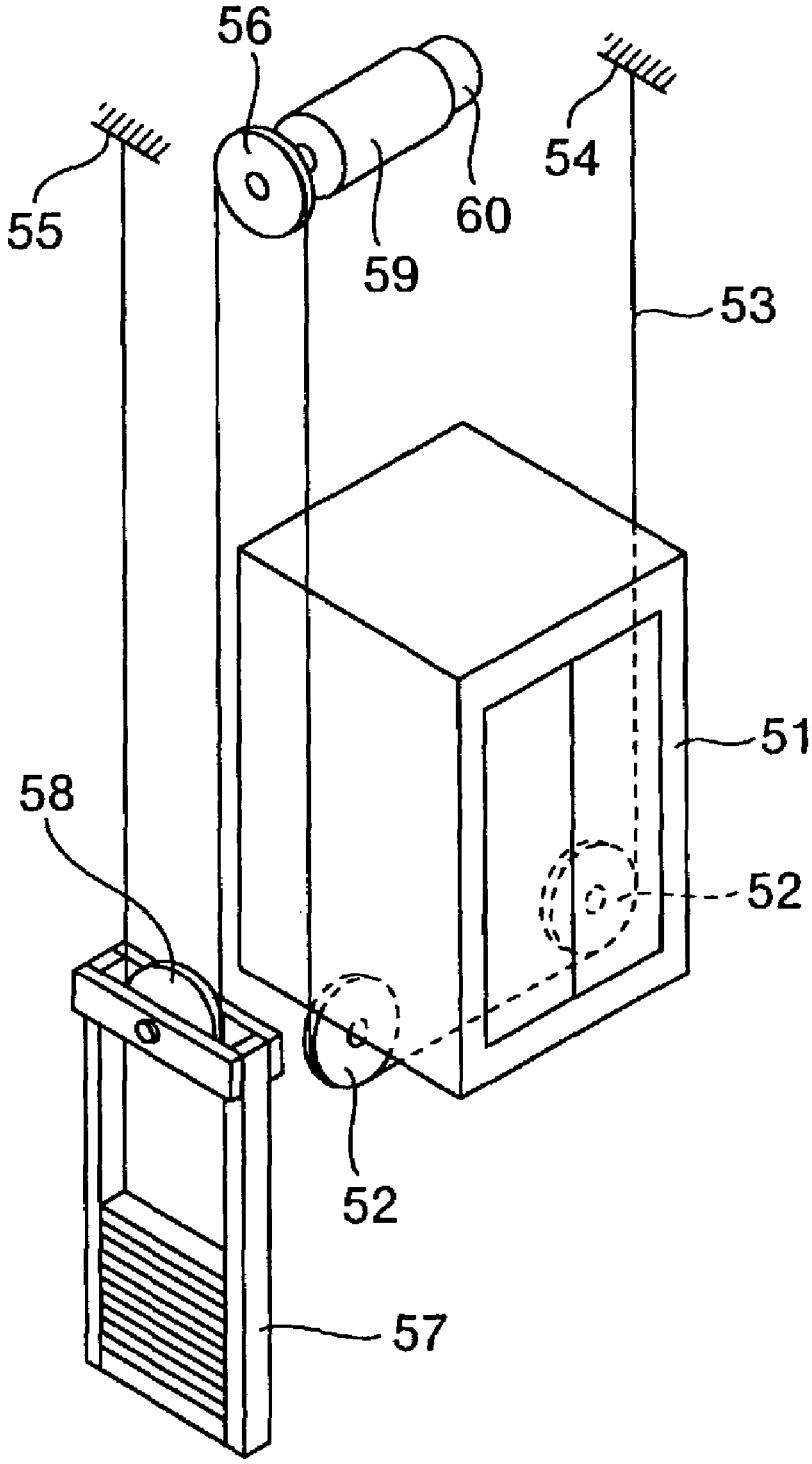
FIG. 8 is a perspective view of a first embodiment of an elevator of the present invention.
Figure 9:
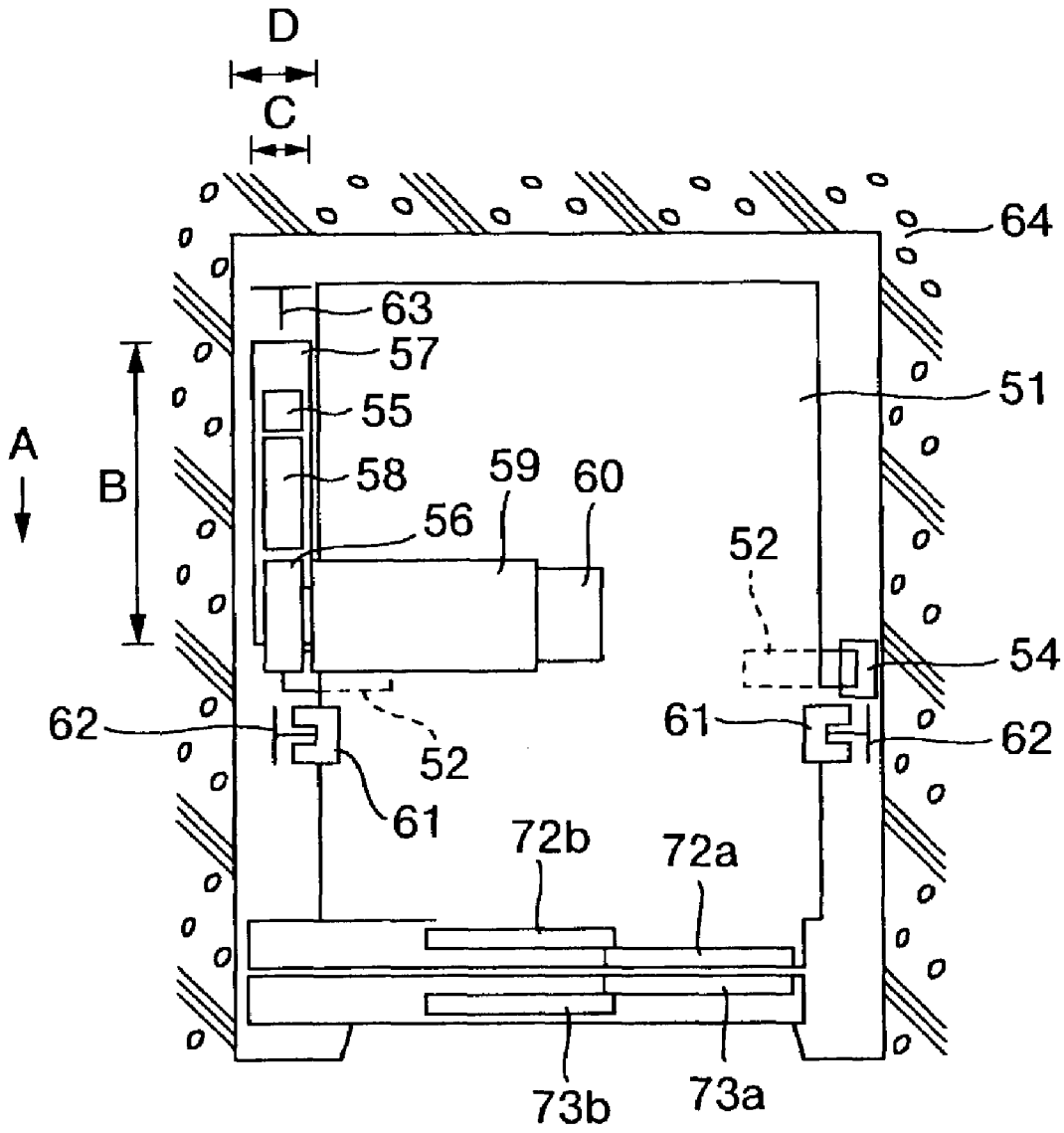
FIG. 9 is a plan view of the first embodiment of the elevator of the present invention.

FIG. 8 is a perspective view of a first embodiment of an elevator using the wire ropes described above. Further, FIG. 9 is a plan view showing an elevating passage in the present embodiment as viewed from the above.

A cage 51 of the elevator is supported by a rope 53 via under-cage pulleys 52. One end of the rope 53 is fixed to a building at a support point 54. The other end is fixed to the building at a support point 55 via the under-cage pulleys 52, a sheave 56, and a counterweight pulley 58 installed in a counterweight 57. Then, a driver 59 rotates the sheave 56 to drive the rope 53 by frictional force generated between the sheave 56 and the rope 53, thereby moving the cage 51 and the counterweight 57 in the vertical direction. The driver 59 is provided with a brake 60.

In FIG. 8, the driver 59 is shown as a gearless type driver comprising a single motor, but may be of a geared type driver using a reduction gear. As shown in FIG. 9, the cage 51 is regulated by guide devices 61 and cage rails 62 so as to move only in the vertical direction. Likewise, although not shown, the counterweight 57 is regulated by a guide device and a counterweight rail 63 so as to move only in the vertical direction. Further, the cage 51 is provided with cage-side doors 72*a* and 72*b* so as to oppose stop-side doors 73*a* and 73*b* installed on a side to a step passage. In FIGS. 8 and 9, the driver 59 is shown to overhang above the cage 51 but may be installed in a gap between the cage 51 and an elevating passage wall 64 using a thinner motor or reduction gear.

When the rope 53 is constructed according to one of the above-described embodiments, the under-cage pulleys 52, sheave 56, and counterweight pulley 58 in FIG. 8 may have smaller diameters than those in an elevator with a conventional rope.

The elevating passage for the elevator has a pit dug in a bottom thereof as a free space. With a configuration using the rope of the present invention, the under-cage pulleys 52 have a small diameter, a dimension of the under-cage pulleys 52 protruding downward from the cage 51 is reduced, and the pit can be formed to be shallower than that in the prior art, so that advantage to reduce costs required to construct the building.

Furthermore, since the size of the under-cage pulleys 52 can be reduced, the total weight of the cage can be reduced to allow the cage to be accelerated and decelerated with reduced driving force. Consequently, the size of the driver or the motor constituting the driver can be reduced, thereby making it possible to reduce the capacity of a power source that supplies the driver with power. Further, although not shown, the cage 51 is generally provided with an emergency stop device that brakes the cage 51 when the rope 53 is broken. Since the total weight of the cage 51 and the under-cage pulleys 52 decreases, braking force needed to the emergency stop device is reduced, whereby it is possible to make the emergency stop device lighter than conventional devices.

Furthermore, by the fact that the diameter of the sheave 56 becomes small, the rotational speed of the sheave 56 required to move the cage 51 at a predetermined speed increases and torque generated by the driver 59 becomes small. That is, the driver 59 operates at an increased speed with reduced torque. Thus, if the driver 59 is of the gearless type driver, it is possible to make the diameter of the motor small. Furthermore, if a geared type driver is used, it is possible to reduce the reduction ratio of the reduction gear or omit the reduction gear. This makes it possible to reduce an area of an installation space for the driver 59 located at the top of the elevating passage, thus obtained is advantage for reducing an amount of protrusion of the elevating passage if a ceiling of the building on the top floor is low.

As shown in FIG. 9, to arrange the driver 59, sheave 56, counterweight pulley 58 and counterweight 58 with good space efficiency, it is preferable that the sheave 56 and the counterweight pulley 58 be substantially linearly arranged in the gap between the cage 51 and the elevating passage wall 64. In this case, when the diameters of the sheave 56 and counterweight pulley 58 are reduced, an installation position of the counterweight pulley 58 is shifted in the direction of arrow A in the drawing. This enlarges a gap between the elevating passage wall 64 and the counterweight 57, above in the drawing, thereby making it possible to increase the width dimension (dimension B in the drawing) of the counterweight 57. As a result, thickness of the counterweight 57 (dimension C in the drawing) required to construct a counterweight of the same weight becomes small, thus making it possible to reduce a gap (dimension D in the drawing) between the cage 51 and the elevating passage wall 64. Therefore, obtained is advantage that an area occupied by the elevating passage decreases.

Further, the use of the rope of the present invention, described above, as the rope 53 in FIGS. 8 and 9 produces the following advantages.

First, the life of the rope 53 is extended, so that it is possible to extend rope replacement period. That is, the coefficient of friction between the rope 53 and the sheave 53 becomes larger than the case in which a conventional rope is used, so that it is possible to reduce pressing force of rope 53 against the sheave 56. The pressing force is generated by tension of the rope resulting from the total weight of the cage 51 and the counterweight 57. Accordingly, slippage never occur between the rope 53 and the sheave 56 even if the pressing force is reduced, that is, the total weight of the cage 51 and the counterweight 57 is reduced. With this, obtained is advantage to reduce the manufacturing costs of the cage 51 and the counterweight 57 as well as the capacities of the driver 59 and the power source.

In the embodiment shown in FIG. 9, the longitudinal axes of the under-cage pulleys 52 and the sheave 56 are substantially perpendicular to each other rather than extending in the same direction. If a conventional flat belt is used in an elevator of such layout, the belt is twisted between the under-cage pulleys 52 and the sheave 56. The twisted flat belt obliquely enters the under-cage pulleys 52 and the sheave 56, which becomes a cause of partial wear or an instability of the friction characteristic. In contrast, the rope 53 of the present invention is substantially circular in cross section and therefore, there is no case in which a partial wear is resulted and the frictional characteristic becomes unstable, even if a layout in which twisting of the rope occurs is employed.

Further, resin fiber ropes may be altered or degraded when exposed to ultraviolet rays, and thus cannot be used under conditions that sunlight is incident directly or indirectly on the elevating passage as in the case with observation elevators or elevators provided at outdoor. In contrast, the rope of the present invention uses steel wires as strengthen members for bearing loads. Therefore, it is not degraded even when exposed to ultraviolet rays but can be used even in the environment described above.

Furthermore, at temperature of about 200–700° C., the resin fiber rope may be altered to have its strength extremely reduced. Accordingly, when used in an elevator, the resin fiber rope may be broken by a fire in the building depending on its material. Further, when a flat belt with steel twisted wires becomes hot due to a fire in the building, sheathing resin material used to bundle the steel twisted wires may melt to allow the twisted wires to be entangled with each other, thereby causing the elevator to malfunction. In contrast, the rope of the present invention uses steel wires as strengthen members for bearing loads. Consequently, even if the elevating passage becomes hot because of a fire, only the resin coating material may melt and the strength is maintained up to about 1,000° C. as in the case with conventional wire ropes. Since elevators are prohibited from being used while the building is on fire, the degradation of the durability of the rope caused by a fire in the building does not directly contribute to impair the safety of the elevator, but the above-described feature provides effective measures if the elevator is being used when the building is caught by fire due to an unexpected accident.

Further, in an elevator structured by a conventional wire rope, the larger a lifting height becomes, the longer the length of the rope becomes. In this case, since the rope must support its own weight, the strength of the rope must be further increased. In contrast, the rope 53 of the present invention has a lighter weight per unit length than conventional wire ropes of equivalent strength. Thus, even when used in an elevator with a large lifting height, the present rope can suppress an increase in suspension loads caused by its own weight.

The rope of the present invention is light weight and therefore, rope transporting, installing, and removing operations performed when the elevator is installed or the rope is replaced with a new one become easy.

Further, in a prior art combination of a wire rope and a steel sheave, noise occurs due to the contact between the rope and the sheave. This tendency is significant in a high-speed elevator in which the sheave rotate at a high speed. In contrast, when the rope of the present invention is used, since its surface is coated with the resin, which is softer than steel, the contact noise is prevented regardless of whether the sheave are made of steel or resin.

Furthermore, conventional wire ropes are impregnated with lubricant to prevent wear between the wires or between the strands. Therefore, there is possibility that oil contamination occurs such as splash of the lubricant and adhering of the lubricant to clothes. In contrast, the rope of the present invention uses no lubricant and therefore, oil contamination never occur. In general, the wire rope of the elevator is not exposed into the cage or a passenger section, but the above advantage is effective in preventing the elevating passage wall from being contaminated or in improving the operating environment for maintenance and inspection workers.

Moreover, the resin fiber rope generally has large initial elongation when it is initially used, and its length must be adjusted after a fixed time lapsed from the installation. This is because the resin fibers are softer than steel wires, so that it takes much time that the fibers are adapted to each other and come into close contact with each other. In contrast, the center of the rope of the present invention is structure by steel wires, and therefore, its initial elongation becomes stable early as in the case with conventional wire ropes, thereby eliminating the need to adjust the rope length again.

The rope of the present invention has its surface coated with the resin, and therefore, it can be arbitrarily colored by properly selecting the type of the resin or mixing a pigment into the resin. Thus, for observation or outdoor elevators, the presence of the rope can be made unnoticeable by making it in the same color as that of the building or elevating passage, or conversely, the operation of the elevator can be emphasized by making it in a color completely different from that of the building or elevating passage. Alternatively, different parts of the rope may be made in respective colors, so that different combinations of colors are viewed depending on the vertical position of the cage 51. In this case, it is needed to prevent the resin layer from being separated at boundaries of the colors. Thus, without mixing pigments into the resin beforehand, pigments are mixed with the resin simultaneously with an operation to continuously effect a resin coating on an outer circumference of the rope body, and by changing the pigments to be mixed, it is possible to color the resin layer with different colors while the resin layer is a continuous layer. As described above, an effect to improve design can be obtained by coloring the rope 53.

Figure 10:
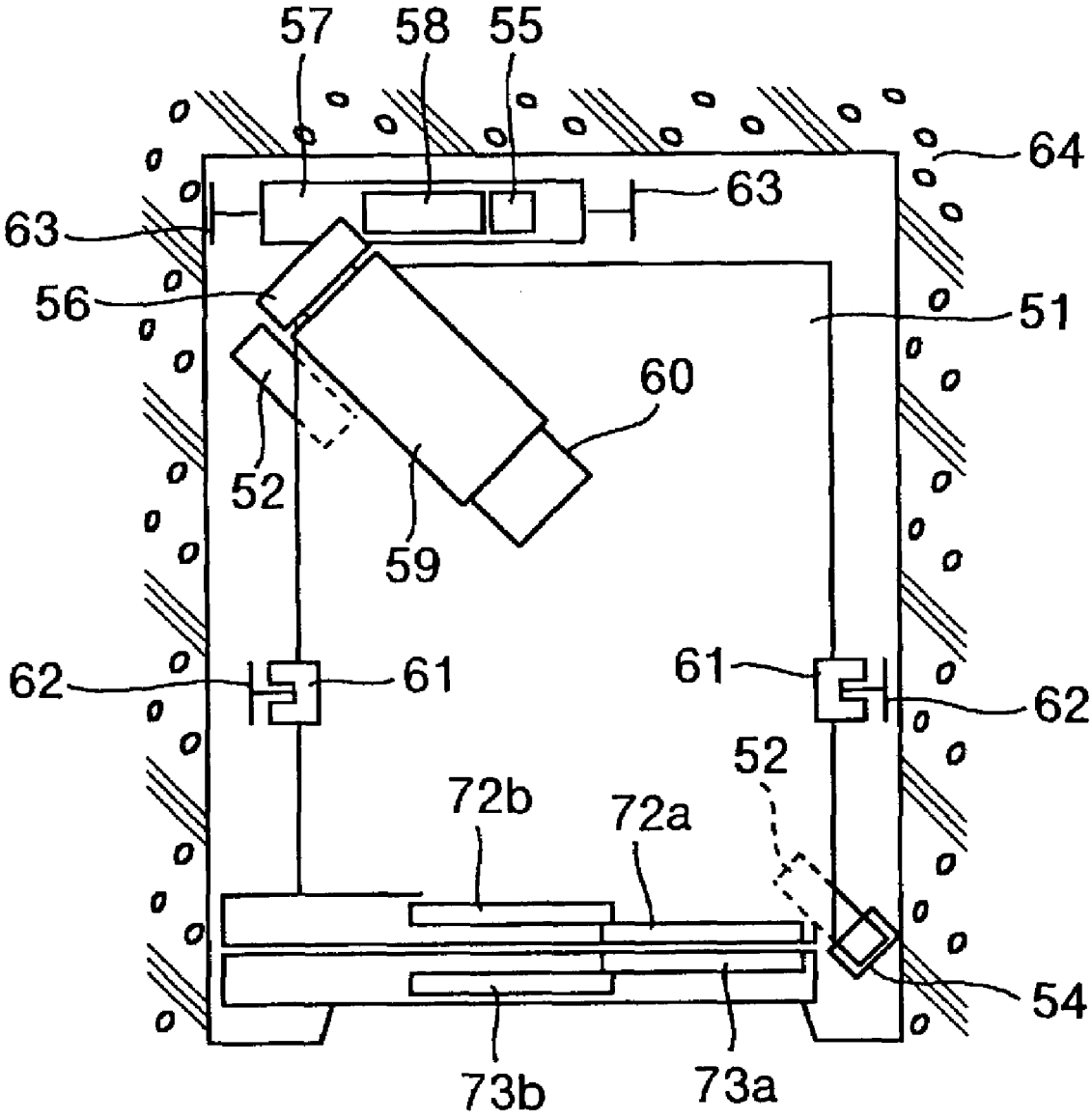
FIG. 10 is a plan view of a second embodiment of the elevator of the present invention.

FIG. 10 is a plan view of a second embodiment of the elevator using the rope of the present invention. The present embodiment differs from the embodiment shown in FIG. 9 mainly in that the counterweight 57 is installed at a different position. That is, the counterweight 57 is installed between a side of the cage 51 located opposite the cage-side doors 72*a* and 72*b* and the elevating passage wall 64. Correspondingly, the under-cage pulley 52, sheave 56, and driver 59 are arranged at different positions. These differences in arrangement are resulted from the limitation of the layout of the building. As shown in FIG. 10, in the present embodiment, the longitudinal axes of the under-cage pulley 52 and sheave 56 extend in different directions, and the longitudinal axes of the sheave 56 and counterweight pulley 58 also extend in different directions. That is, the rope is twisted between the pulley 52 and the sheave 56 and further twisted between the sheave 56 and the counterweight 58. Hence, if a conventional flat belt is used in an elevator with such arrangement, a partial wear may occur or the friction characteristic may become unstable as compared with the structure shown in FIGS. 8 and 9. However if the rope of the present invention is used in the arrangement shown in FIG. 10, a partial wear and an unstable phenomenon of the friction characteristic never occur because of generally circular cross section of the rope, which is a feature of the present invention. That is, the arrangement of the present embodiment is a structure in which the advantages of the rope of the present invention can be more utilized.

Figure 11:
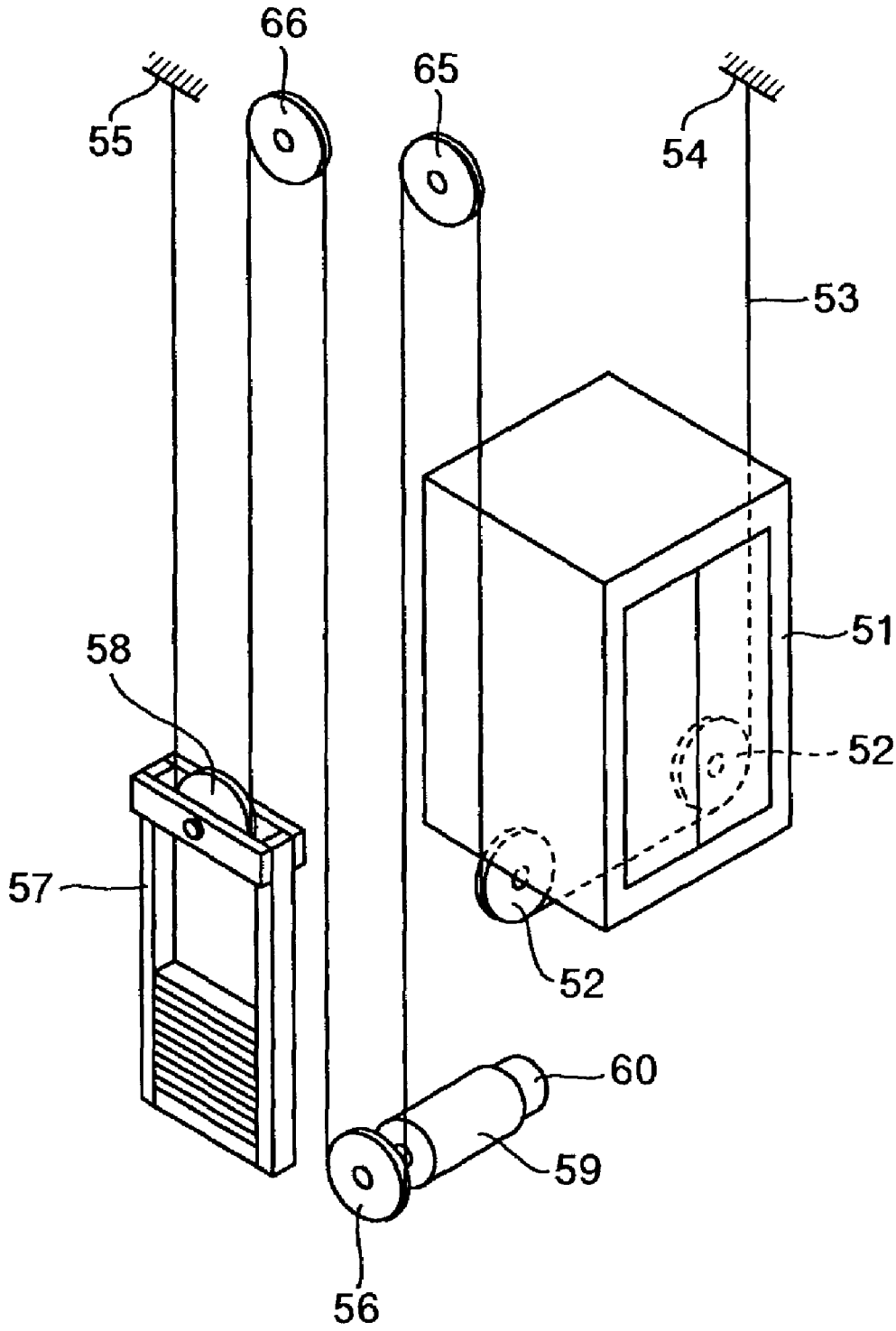
FIG. 11 is a perspective view of a third embodiment of the elevator of the present invention.

FIG. 11 is a perspective view of a third embodiment of the elevator using the rope of the present invention. In the present embodiment, top pulleys 65 and 66 are used to install the sheave 56, driver 59, and brake 60 at the bottom of the elevating passage. A main advantage of this construction is that the driver 59, which has possibility to make noise in general, can be installed at the bottom of the elevating passage, where noise is hard to become a problem relatively, instead of the top of the elevating passage, where noise is easiest to resound. On the other hand, compared to the embodiment shown in FIGS. 8 and 9, the entire length and weight of the rope 53 become longer and heavier, and therefore, there is a problem that a large amount of time and labor for installation operation is required. However, when the rope of the present invention is used in this construction, obtained is an effect that weight of the entire rope is reduced and the installation operation becomes easy. That is, the present embodiment is a structure in which the advantage that the rope of the present invention is light is more utilized.

Figure 12:
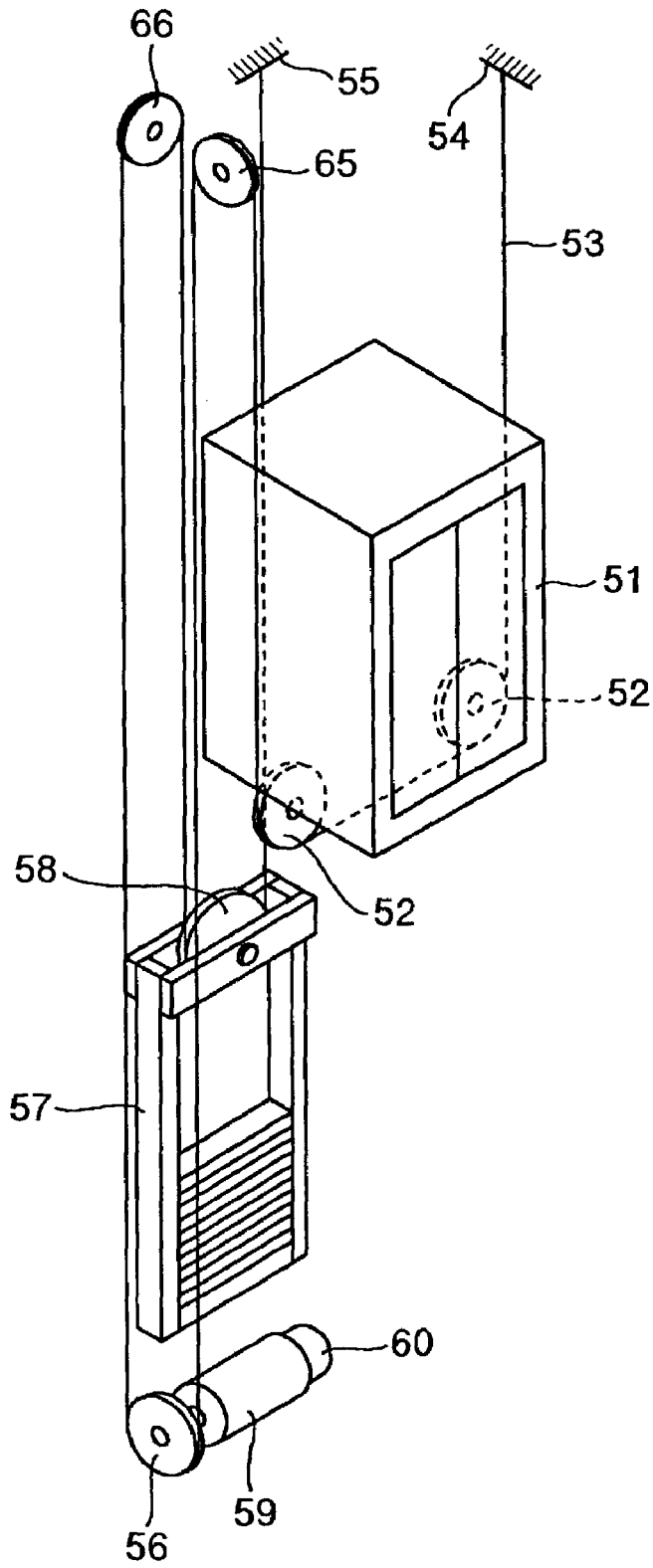
FIG. 12 is perspective view of a fourth embodiment of the elevator of the present invention.

FIG. 12 is a perspective view of a fourth embodiment of the elevator using the rope of the present invention. In the present embodiment, the position of the counterweight 57 shown in FIG. 11 is arranged behind the cage as shown in FIG. 10. Naturally, the present embodiment has both the problem in FIG. 10, i.e. the rope 53 is twisted at two locations, and the problem in FIG. 11, i.e. the weight of the entire rope is increased because the rope length is long. However, by using the rope of the present invention, it is possible to prevent the partial wear and unstable of the friction characteristic and to reduce the weight of the whole of the rope, even with a layout that requires the rope to be twisted.

Figure 13:
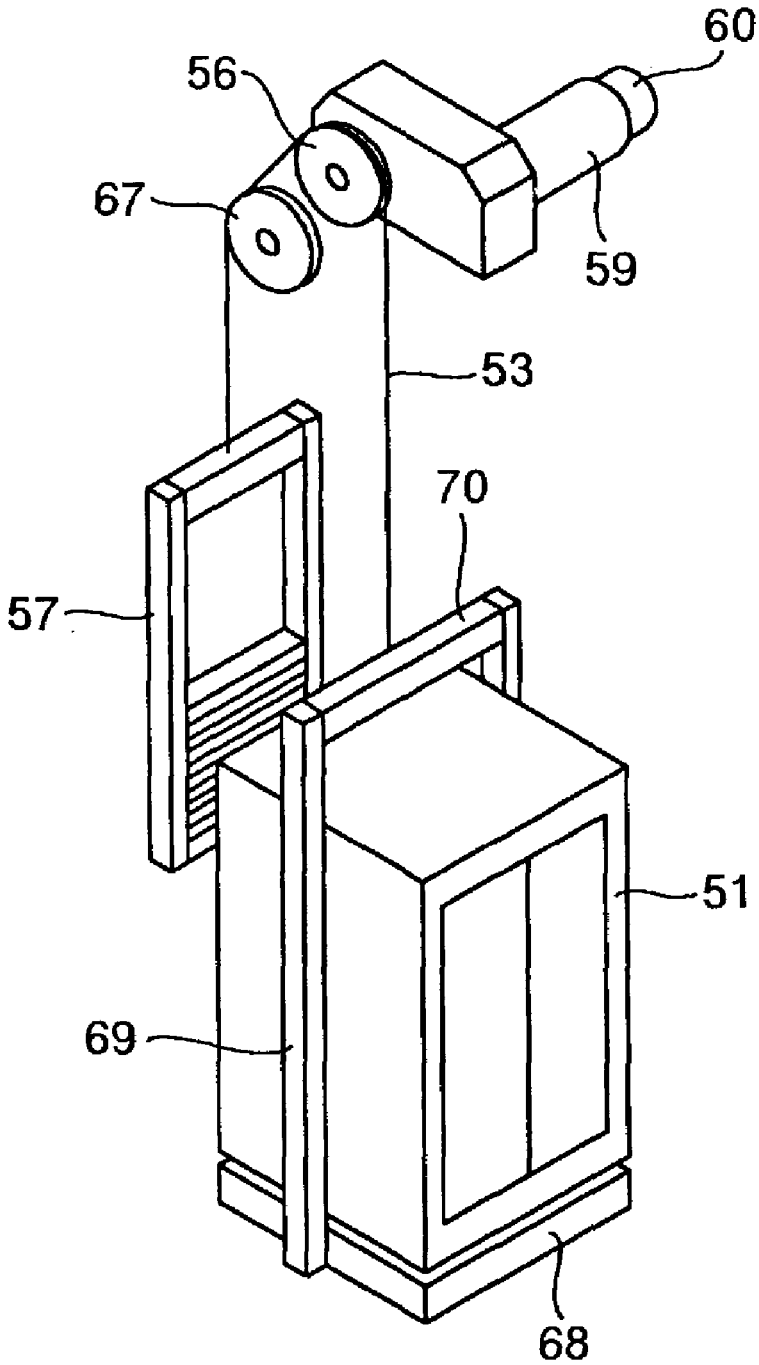
FIG. 13 is perspective view of a fifth embodiment of the elevator of the present invention.

FIG. 13 is a perspective view of a fifth embodiment of the elevator using the rope of the present invention. In the present embodiment, the sheave 56, driver 59 and brake 60 are arranged at the top of the elevating passage or in a machine room provided above the elevating passage. The cage 51 is supported by a cage frame 68 and suspended by the rope 53 via a vertical frame 69 and a cross-head 70. One end of the rope 53 is attached to the cross-head 70, while the other end is attached to the counterweight 57 via the sheave 56 and a deflector wheel 67. The sheave 56 is rotated to drive the rope 53 by frictional force generated between the sheave 56 and the rope 53, thereby moving the cage 51 and the counterweight 57. The support of the cage 51 via the cage frame 68 and the use of the deflector wheel 67 are not indispensable requirement of the present invention.

The present embodiment is widely used as an elevator construction, but the present arrangement can also use the rope of the present invention. Specifically, in the structure of the present embodiment, the deflector wheel 67 is often used and therefore, a winding angle, i.e. an angle range at which the rope 53 is wound around the sheave 56, is apt to be smaller in comparison with the structure in which the deflector wheel 67 is not used. The frictional force between the sheave 56 and the rope 53 has a characteristic to decrease consistently with the winding angle. Thus, the frictional force is insufficient that the rope 53 is prone to slip on the sheave 56. In contrast, when the rope 53 of the present invention is used, higher frictional force is obtained in comparison with the conventional wire ropes, thereby providing a reliable elevator that prevents the rope 53 from slipping.

Figure 14:
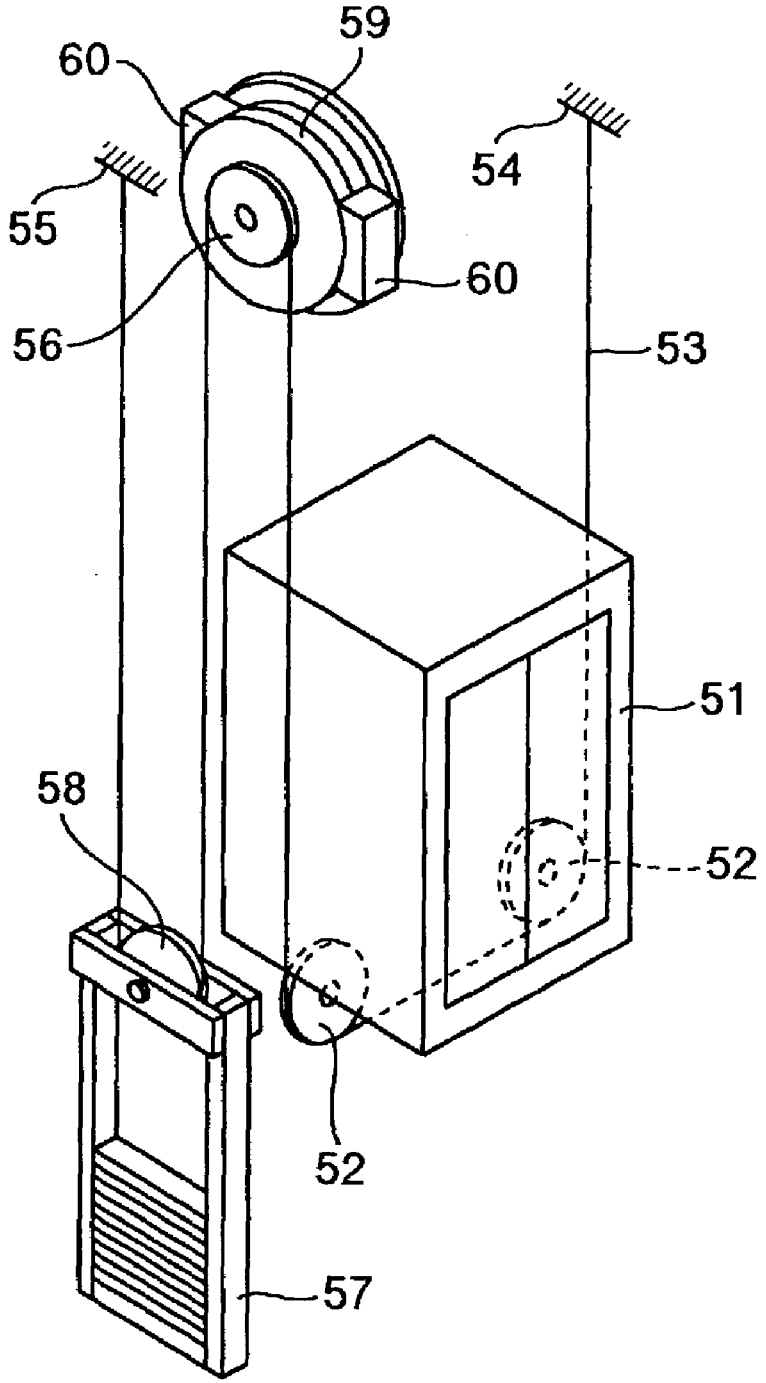
FIG. 14 is perspective view of a sixth embodiment of the elevator of the present invention.

FIG. 14 is a perspective view of a sixth embodiment of the elevator using the rope of the present invention. The present embodiment uses a thin cylindrical driver 59 having a smaller thickness relative to its diameter, the brake 60, and the sheave 56. Then, by arranging the driver 59 in a gap between the elevating passage and the cage 51, it is possible to reduce the space at the top of the elevating passage in which, in other structure, the driver is installed. The driver 59 in the present embodiment is preferably structured by a permanent-magnet-type gear-less synchronous motor. In this case, if the sheave 56 has a large diameter, the rotational speed of the sheave 56 needed to move the cage 51 at the same speed becomes small and the torque generated by the driver 59 increases. Thus, the diameter of the motor constituting the driver 59 must be made excessively large. In contrast, when the rope of the present invention is used, the diameter of the sheave 56 can be reduced, thus enabling the diameter of the driver 59 to be appropriately reduced to lessen the size of the elevating passage.

Figure 15:
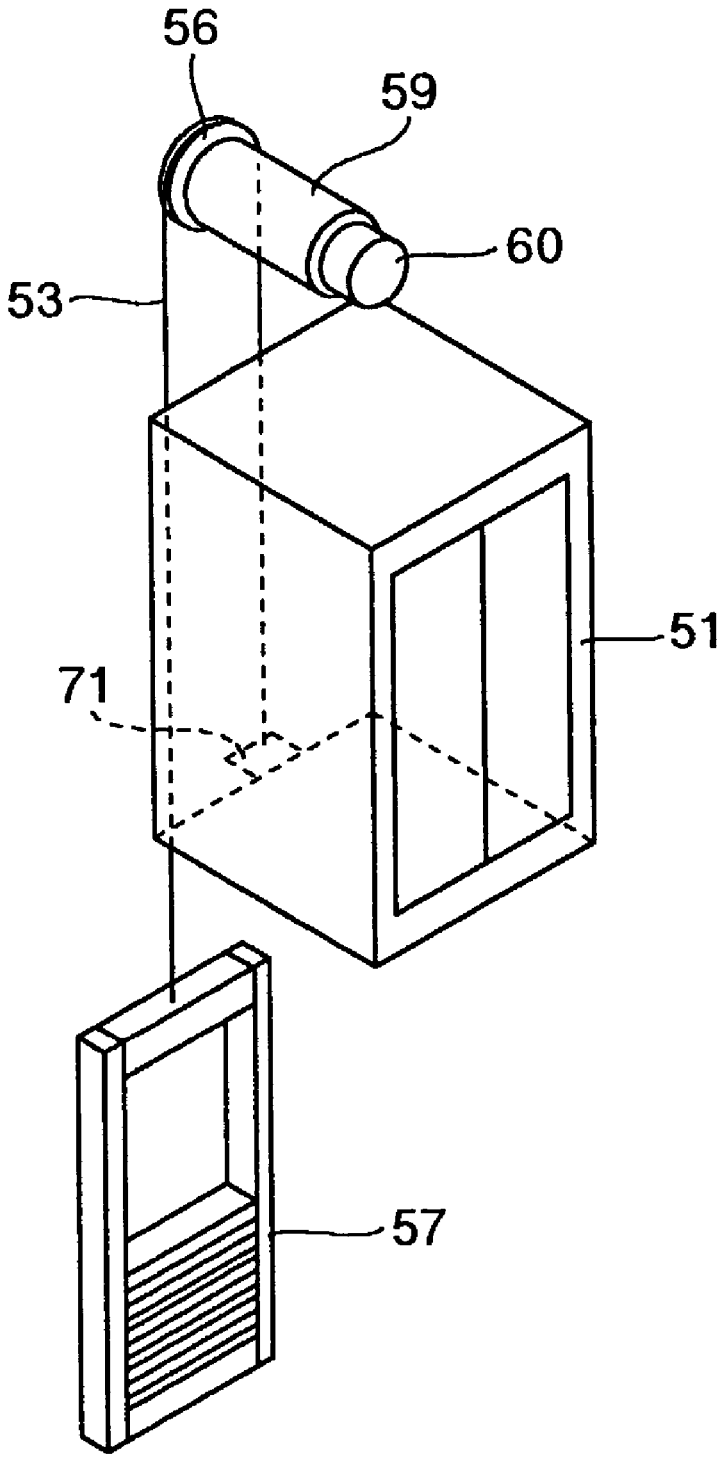
FIG. 15 is perspective view of a seventh embodiment of the elevator of the present invention.

FIG. 15 is a perspective view of a seventh embodiment of the elevator using the rope of the present invention. In the present embodiment, the cage 51 is suspended at a suspension point 71 by the rope 53. The rope 53 is connected to the counterweight 57 via the sheave 56. This configuration does not require any vertical frame or cross head to suspend the cage 51, and therefore, has an advantage simplifying the structure around the cage. Furthermore, since the cross-head is not required, an overall height including the cage and the cross head is reduced, and therefore, it becomes possible to structure an extra space to be provided at the top of the elevating passage small. In this case, since the driver 59 is installed in the extra space, the smaller the height dimension of the driver 59 becomes, the smaller the extra space becomes. Then, when the rope of the present invention is used, the diameter of the sheave 56 becomes small and consequently, the diameter of the motor constituting the driver 59 also becomes small, so that the height dimension of the driver 59 is reduced. With this, obtained is an advantage that the extra space at the top of the elevating passage can be made smaller.

Figure 16:
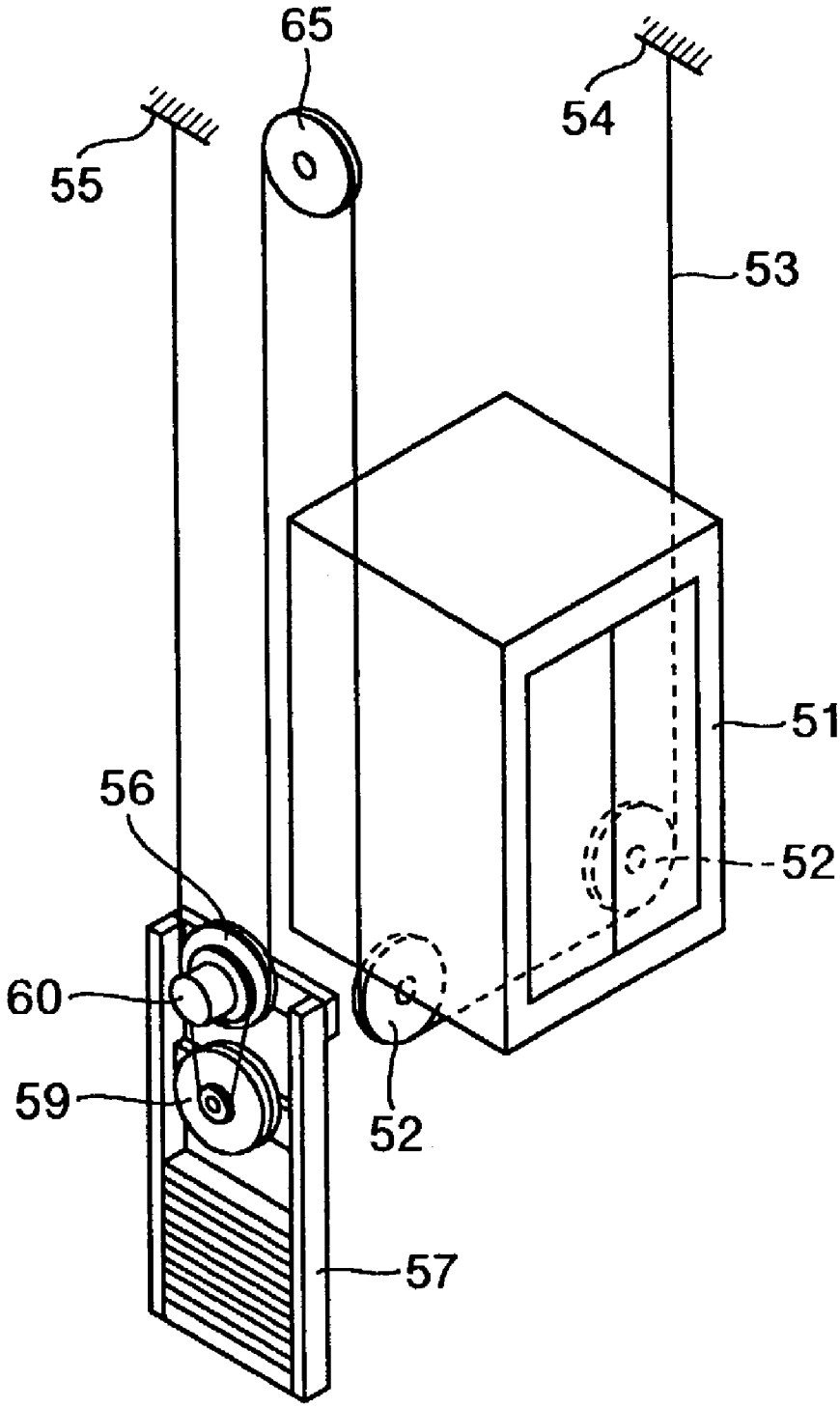
FIG. 16 is perspective view of an eighth embodiment of the elevator of the present invention.

FIG. 16 is a perspective view of an eighth embodiment of the elevator using the rope of the present invention. The present embodiment is one in which the driver 59, brake 60 and sheave 56 are installed inside the counterweight 57 and the rope 53 is driven by the sheave 56 to move the cage 51 and counterweight 57 in the vertical direction. In the structure of the present embodiment, there is no need to arrange the driver and the like at the building side, and therefore, it becomes possible to reduce the elevating passage space more than the prior art. However, to install the driver 59, brake 60 and sheave 56 inside the counterweight 57, the sizes of these devices must be reduced. Against this, if the rope of the present invention is used, it is possible to reduce the diameter of the sheave 56, so that the driver 59 and brake 60 are made smaller, thus enabling these devices to be installed inside the counterweight 57.

In FIG. 16, the driver 59, brake 60, and sheave 56 are installed inside the counterweight 57, but also in a case that these devices are installed on the cage 51, the same effect can be obtained by using the rope of the present invention.

Figure 17:
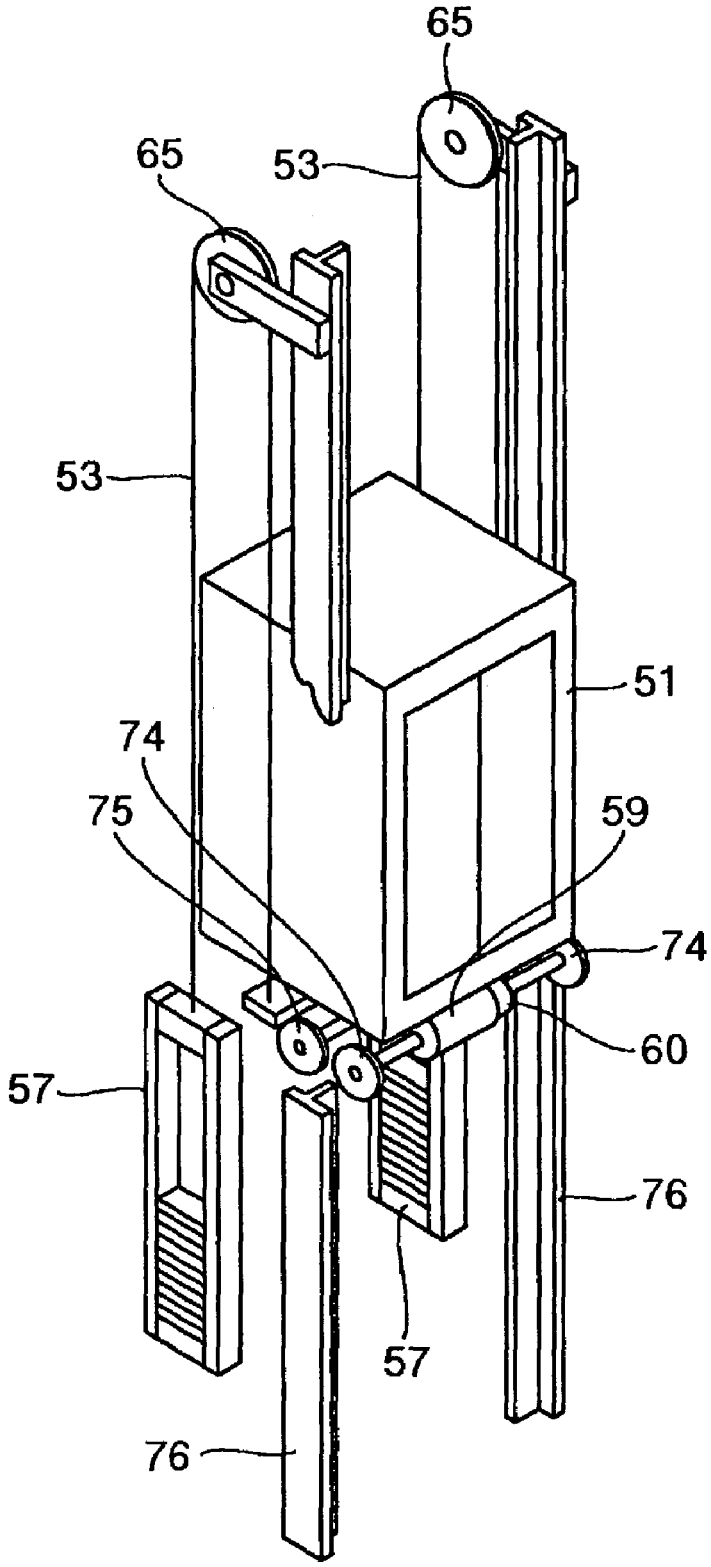
FIG. 17 is perspective view of a ninth embodiment of the elevator of the present invention.

FIG. 17 is a perspective view of a ninth embodiment of the elevator using the rope of the present invention. The present embodiment is one in which, the cage 51 and the counterweights 57 are connected through top pulleys 65 and the ropes 53, and rails 76 are sandwiched between drive rollers 74 and press rollers 75, and the driver 59 is used to rotate the drive roller 74 to move the cage 51 and the counterweights 57 in the vertical direction. Similarly to the embodiment in FIG. 16, the present embodiment does not require any driver and others to be installed at the building side, and therefore, has an effect reducing the area of the elevating passage space. Here, not to burden suspension loads with the building side, the structure is preferable that the top pulleys 65 are supported by the rails 76. However, not to enlarge the elevating passage, there is need to arrange the top pulleys 65 so as to shift their centers in a horizontal direction from the rail 76. In this case, a bending moment by suspension loads act on the rails 76, which is thus prone to buckle. Against this, if the rope of the present invention is used, the size of the top pulleys 65 can be reduced, thereby lessening the horizontal shift between the top pulleys 65 and the rails 76 as well as the bending moment. Consequently, the weight of the rail 76 can be reduced.

The rope of the present invention can be used for applications other than the elevators described above. As ne of such applications, the application of the present invention to a lifting crane will be described. In general, the lifting crane is often used outdoors or in a relatively large indoor space, so that the ropes constituting the crane are prone to be exposed to wind and rain or dust. Thus, possible wear caused by rust or dust shortens the life of the rope. Against this, since the surface of the rope of the present invention is coated with the resin layer, the steel twisted wire portion, which is a strength constitution portion, is not exposed directly to wind and rain or dust. Therefore, it is possible to extend the life of the rope in comparison with the conventional wire ropes.

Further, in the rope of the present invention, it is easy to color the surface resin layer. Accordingly, by coloring the surface resin layers in visible colors, a lifting crane operator or workers performing wire handling operations around the crane can easily find the ropes. Consequently, a crane having high safety and operability can be structured. In this case, the color of the surface resin layers of the ropes are preferably yellow, orange, and various fluorescent colors. However, if surrounding environments have colors similar to the above-mentioned colors and thus this coloring does not improve visibility, other colors can of course be used.

As an example in which the rope of the present invention is used for applications other than the elevators, an explanation will be given of the case where the present rope is applied to gondolas or lifts used in a skiing ground. Such gondolas or lifts are often used outdoors similarly to the lifting crane, described above. The rope of the present invention is coated with the resin and thus has high weatherability and extended life.

Further, the appearance of conventional wire ropes is not suitable to the scenery of the skiing ground because the steel wires are exposed in state. In contrast, the rope of the present invention allows the surface resin layer to be easily colored, and therefore, it is possible to structure lifts having appearance suitable to the scenery. For example, if the presence of the lifts is to be made unnoticeable, the ropes are preferably colored in white or a light color similar to white. Conversely, if the lifts are to be made noticeable in the direction in which the lifts extend, a visible color such as red, blue, or green is suitable. In particular, by coloring the ropes of adjacent lifts in different colors, obtained is an effect that it is easy to discriminate which direction the lift which a passenger is selecting moves.

Furthermore, for chair type lifts, passengers are seated immediately below the wire rope. Then, a problem arises that the passengers' clothes may be stained by falling of droplets of the lubricant depending on how lubricant is applied to the wire rope. In contrast, the rope of the present invention does not require the lubricant to be applied, and therefore, there is no fear to stain the passengers' clothes.

By the way, the ropes used for the lifts in the skiing ground must be endless, i.e. the opposite ends thereof must be joined together. For conventional wire ropes, the rope is made endless by unraveling the strands constituting the rope and executing a splicing process to braid the strands protruding from the opposite ends. In contrast, the rope of the present invention can be made endless by the following operation:

A fixed section of the surface coating resin at each end of the rope is removed. Then, the strands constituting the steel rope are unraveled, and a splicing process is executed to braid the strands protruding from the opposite ends. Subsequently, the processed portion is coated with the resin material again.

In this case, if rainwater or the like permeates into the rope through the re-coated portion, the rope may be rusted and become weaker. Thus, the re-coating must be applied at least in a waterproof manner. As a preferred example, the rope may be coated with a tube composed of a heat-shrinkable resin, by heating the tube, or a resin tape with pressure sensitive adhesive may be wound around the rope. Alternatively, the rope may be made more waterproof by using sealing material to close the interface between the original surface resin layer and the re-coated resin.

The present invention, constructed as described above, suppresses the shortening of the life of the rope, which may occur if the sheave of the elevator have reduced diameters, or extends the life of the rope. Thus, the present invention reduces the size and weight of equipment including a motor and a hoist, saves the space required to install the elevator, and improves the safety and reliability of the system by extending of the life of the rope.

The invention claimed is:

1. An elevator comprising a cage and a counterweight connected together by a plurality of main ropes, and said plurality of main ropes are wound around a sheave and are driven by the sheave which is driven by a motor, wherein:

each of said plurality of main ropes comprises a plurality of strands twisted together and each of said plurality of strands comprises a plurality of wires twisted together, each of said plurality of main ropes is coated with resin material and has a substantially circular cross section, a ratio D/d between a diameter D of said sheave and a diameter d of said plurality of main ropes is 40 or less, and a diameter δ of said wires and the diameter D of said sheave satisfies the following expression $$E\delta/2D<260 \text{ (MPa)}$$

where E represents a longitudinal elastic modulus of the wire.

2. An elevator according to claim 1, wherein the diameter of said wires is 0.25–0.5 mm.

3. An elevator according to claim 1, wherein each of said plurality of wires is coated with resin material.

4. An elevator according to claim 1, wherein each of said plurality of main ropes includes a fiber core arranged in a center thereof.

5. An elevator according to claim 1, wherein at least one of said plurality of strands which is arranged in a center of said main ropes is coated with resin material.

6. An elevator according to claim 1, wherein each of said plurality of strands is coated with resin material.

7. An elevator according to claim 6, wherein lubricant is filled into the coating of each of said plurality of strands.

8. An elevator according to claim 1, wherein the coating of each of said main ropes has a plurality of layers.

9. An elevator according to claim 1, wherein each of said plurality of main ropes is formed using Lang's lay in which the wires and the strands are twisted in the same direction.

10. An elevator according to claim 1, wherein said sheave has grooves coated with resin material.

* * * * *